United States Patent [19]

Abe et al.

[11] 4,230,087

[45] Oct. 28, 1980

[54] LOW-NOISE-LEVEL INTERNAL COMBUSTION ENGINE

[75] Inventors: Fumiyuki Abe; Yoshimasa Hayashi, both of Yokohama; Akira Kimura, Kawasaki, all of Japan

[73] Assignee: Nissan Motor Company, Limited, Yokohama, Japan

[21] Appl. No.: 959,474

[22] Filed: Nov. 13, 1978

[30] Foreign Application Priority Data

Nov. 17, 1977 [JP] Japan ..... 52/138296

[51] Int. Cl.[3] ..... F02F 1/00; F02B 77/00

[52] U.S. Cl. ..... 123/193 CH; 123/195 C; 123/198 E

[58] Field of Search ..... 123/198 E, 193 CH, 195 C; 181/204

[56] References Cited

U.S. PATENT DOCUMENTS

| | | | |
|---|---|---|---|
| 3,464,398 | 9/1969 | Scheiferlein | 123/198 E |
| 3,684,053 | 8/1972 | Fachbach et al. | 123/198 E |
| 3,691,914 | 9/1972 | Reisacher et al. | 123/193 CH |
| 3,924,597 | 12/1975 | Hatz et al. | 123/195 C |
| 4,071,008 | 1/1978 | Skatsche et al. | 123/198 E |
| 4,092,956 | 6/1978 | List et al. | 123/193 CH |

*Primary Examiner*—Ira S. Lazarus

[57] ABSTRACT

A reciprocating piston internal combustion engine comprises an integrally formed or cast engine block having an upper half of main bearings for receiving the journal of a crankshaft, a bearing support frame secured to the bottom portion of the engine block and having a lower half of the main bearings, and a sound-insulating cover secured to the outer surface of the engine block to cover the lower part of the engine block, so that the engine noise and vibration can be effectively decreased.

11 Claims, 3 Drawing Figures

LOW-NOISE-LEVEL INTERNAL COMBUSTION ENGINE

BACKGROUND OF THE INVENTION

This invention relates to a low-noise and low-vibration level internal combustion engine, and more particularly to a multi-cylinder, reciprocating piston internal combustion engine provided with means for lowering the noise level and vibration level of the engine.

In order to effectively reduce the noise level of a reciprocating piston internal combustion engine, it has already proposed to shorten the piston stroke of the engine and decrease the mass of engine parts which reciprocally move. Such shortening of the piston stroke particularly contributes to reduction of engine vibration, since this necessarily causes connecting rods to be shortened, reducing the force of inertia of reciprocally moving parts to a considerable extent. An engine having thus shortened piston stroke is called "short-stroke engine" in which the piston stroke is usually smaller than bore diameter of an engine cylinder.

However, such shortening of the piston stroke brings about the increase in bore diameter of the cylinder, for the purpose of obtaining the same volume of the cylinder. This causes the increase in longitudinal distance of a multi-cylinder engine, accompanying decrease in height of the body of the engine. Therefore, the flexural rigidity in the longitudinal direction of the engine body is lowered in cooperation with the fact that the engine body is formed of a cylinder block and a cylinder head which have been formed separately and independently.

This lowering in flexural rigidity of the engine body contributes to increase the engine vibration to a considerable extent, causing engine noise level to increase. Moreover, this leads to deterioration in durability of the engine.

SUMMARY OF THE INVENTION

It is the principle object of the present invention to provide an improved reciprocating piston internal combustion engine, by which its noise level and engine vibration are decreased to a considerable extent.

Another object of the present invention is to provide an improved internal combustion engine, in which the engine vibration can be decreased by forming or casting integrally a cylinder block portion and a cylinder head portion, and engine noise can be decreased by employing a so-called short-stroke arrangement in cooperation with using a sound-insulating cover for covering the outer surface of the cylinder block portion of the engine.

A further object of the present invention is to provide an improved internal combustion engine whose engine block portion is not integrally provided with an oil pan, the oil pan being formed at the bottom-most portion of a sound-insulating cover for covering the engine block.

A still further object of the present invention is to provide an improved reciprocating piston internal combustion engine, in which main bearings for a crankshaft are supported by the supporting portions of an engine block and the supporting portions of a bearing support frame which is secured to the bottom portion of the engine block.

Other objects, features and advantages of the improved reciprocating piston internal combustion engine will become more apparent from the following description taken in conjunction with the accompanying drawings.

DESCRIPTION OF THE PREFERRED EMBODIMENT

Figure 1:
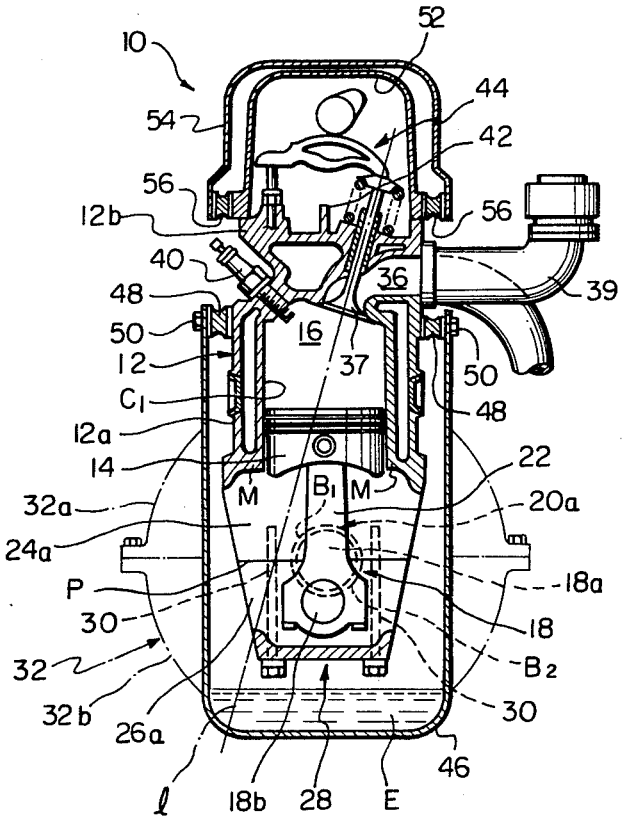
FIG. 1 is a schematic cross-sectional view of a preferred embodiment of a reciprocating piston internal combustion engine in accordance with the present invention.
Figure 2:
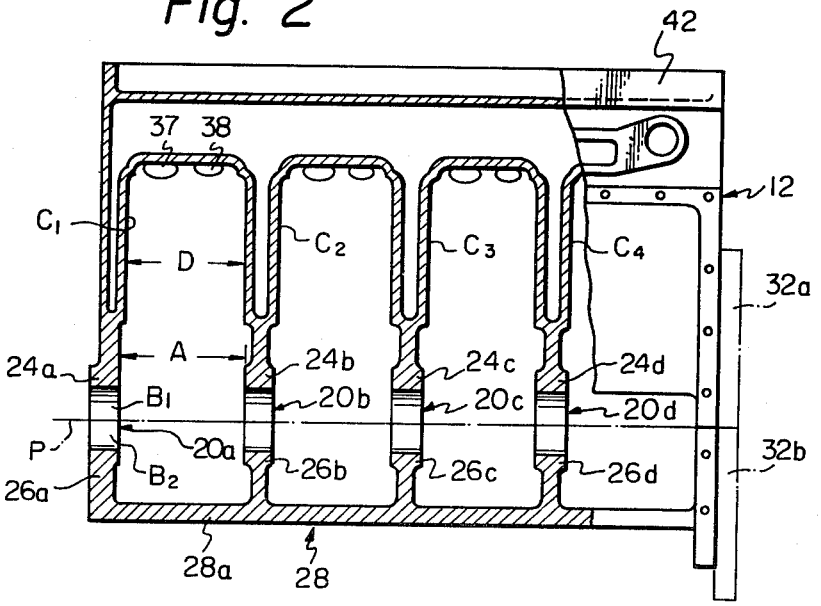
FIG. 2 is a side elevation, partly in section, of the engine of FIG. 1.
Figure 3:
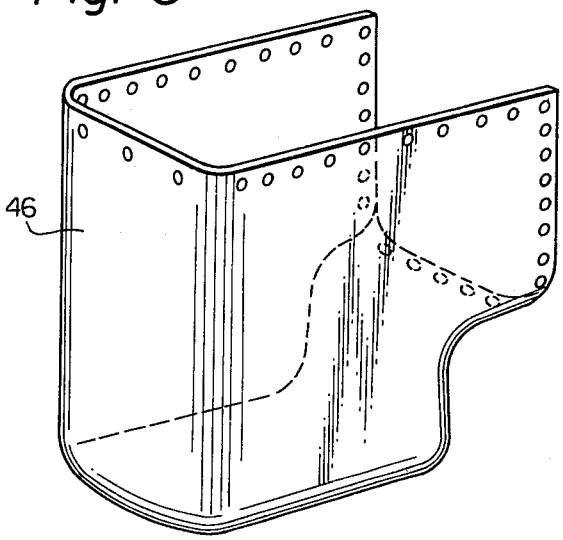
FIG. 3 is a perspective illustration of a sound-insulating cover used in the engine of FIG. 1.

Referring now to FIGS. 1 to 3 of the drawings, there is shown a preferred embodiment of a reciprocating internal combustion engine 10 in accordance with the present invention. The engine 10 is, in this instance, of a motor vehicle and comprises an engine body or an engine block 12. The engine block 10 includes a cylinder block portion 12*a* and a cylinder head portion 12*b*. The cylinder block portion 12*a* is formed therein with four in-line cylinders $C_1$ to $C_4$ as shown in FIG. 2. A piston 14 is reciprocally movably disposed in each cylinder, although only the piston 14 in the cylinder $C_1$ is shown. As viewed, the cylinder head portion 12*b* defines a combustion chamber 16 between it and the crown of each piston. It is to be noted that the engine block 12 is formed or cast integrally and accordingly the cylinder block portion 12*a* is formed or cast integrally with the cylinder head portion 12*b*. In this regard, most conventional engines are constructed and arranged so that a cylinder block is formed or cast separately and thereafter secured to each other by means of bolts.

This engine 10 is of a so-called over-square type in which the piston stroke of each piston 14 is the same as or smaller than the bore diameter D of each cylinder and therefore the engine 10 is also referred to as a "short-stroke engine".

A crankshaft 18 is rotatably supported at its journal 18*a* on main bearings 20 in order to convert the reciprocal movement of the pistons 14 into the rotational movement of the crankshaft 18. As shown, the crankshaft 18 is connected at its piston pin 18*b* to a connecting rod 22 of the piston 14. In this instance, four main bearings 20*a* to 20*d* are used as viewed in FIG. 2. Each main bearing consists of semicylindrical upper part $B_1$ and lower part $B_2$ which constitute a generally cylindrical main bearing. In other words, each of the upper and lower parts $B_1$ and $B_2$ generally forms a half part of the main bearing.

The upper parts $B_1$ of main bearings 20*a* to 20*b* are carried on bearing support portions 24*a* to 24*d*, respectively, which are formed at the bottom of the engine block 12. Conversely, the lower parts $B_2$ of the main bearings 20*a* to 20*d* are carried on the bearing support portions 26*a* to 26*d*, respectively, which are integral with a beam 28*a* of a main bearing support frame 28. The support frame 28 is secured to the bottom of the engine block 12 by a plurality of bolts 30. The bolts 30 are disposed parallelly with the axes (not shown) of the cylinders. Accordingly, the upper and lower parts $B_1$ $B_2$ are located generally opposite to each other with respect to a partition plane P at which the engine block 12 and the main bearing support frame 28 are contacted with each other as clearly shown in FIGS. 1 and 2.

The engine block 12 may be provided integrally with a half part 32*a* of a generally circular flange portion 32 (shown in phantom) to which a transmission case (not shown) is secured. In this connection, the main bearing support frame 28 may be formed integrally with the other half part 32*b* of the flange portion 32. As shown, the two half parts 32*a* and 32*b* may be secured to each other by means of a bolts (no numerals).

As shown in FIG. 1, the engine block 12 is formed at its cylinder head portion 12*b* with an intake port or passage 36 at which an intake valve 37 is closeably disposed. An exhaust port or passage 38 is formed in the cylinder head portion 12*b* of the engine block 12 though not shown in FIG. 1. The intake port 36 communicates with an intake passageway 39 through which intake air is supplied to the combustion chamber 16. The cylinder head portion 12*b* of the engine block 12 is provided with a spark plug 40 so that its electrodes (no numerals) project into the combustion chamber 16. A straight elongate rib 42 is formed on the top surface of the engine block 12 along the longitudinal direction of the engine block 12. The reference numerals 44 generally indicates a mechanism for operating the intake valve 37 and the exhaust valve 38 in accordance with the rotation of the crankshaft 18.

A sound-insulating cover 46 is secured to the outer surface of the middle portion of the engine block through an insulating member 48 or an elastomeric member such as a rubber. The cover 46 is located in spaced relation to and around the lower part of the engine block and the bearing support frame 28 to cover them.

As clearly shown in FIG. 3, the sound-insulating cover 46 is formed with a plurality of holes (no numerals) through which a plurality of bolts 50 are passed to fix the sound-insulating cover 46 to the insulating member 48. The bolts 50 do not reach the wall of the cylinder block 12. It is to be noted that the insulating member 48 provides gas-tight and liquid-tight seals between the inside and outside of the sound-insulating cover 46. The sound-insulating cover 46 serves at its bottom portion as an oil pan for reserving an engine oil E. In this connection, the engine block 12 is not formed with an oil pan and a so-called skirt portion which spacedly covers a crankshaft and to which the oil pan is directly secured.

A rocker cover 52 is secured to the top portion of the engine block 12 to cover the top portion of the engine block including the valve operating mechanism 44. Further, a top insulation cover 54 is secured to the lower portion of the rocker cover 52 through a insulating member 56 or an elastomeric member in order to cover the rocker cover 52. The top insulating cover 54 is, as shown, located to maintain a space between its inner surface and the outer surface of the rocker cover 52.

It is preferable that the distance A between the two adjacent main bearing such as 20*a* and 20*b* is larger than the cylinder bore diameter D, since the cylinder is machined by a machining tool (not shown) which will be inserted through the bottom portion of the engine block bottom portion between adjacent main bearings, and further the piston 14 is inserted through the same engine block bottom portion during assembly of the engine.

It is also preferable to select the inclination of the valve stems of the intake and exhaust valves so that the extensions l of the axes of the valve stems pass under the bottommost periphery M of the cylinder bore as clearly shown in FIG. 1, although only that of the intake valve is shown.

With the thus arranged engine, since the piston stroke is shortened to decrease the masses of reciprocating parts such as the piston 14 and the connecting rod 22, the inertia of force of the reciprocating parts is decreased and accordingly the engine vibration dependent on the inertia force is decreased. As a result, the noises caused by such engine vibration is diminished.

Additionally, the engine vibration is considerably decreased by increasing the flexural rigidity of the engine as follows: (1) The engine block 12 is integrally cast to form the cylinder head portion 12*b* integrally with the cylinder block portion 12*a*. This causes increase in flexural rigidity of overall engine block. (2) The crankshaft 18 is supported through main bearings 20*a* to 20*d* at the bottom portion of the engine block 12 and the main bearing support frame 28 which is separately formed and secured to the engine block bottom portion. This contributes to the increase in the flexural rigidity in the longitudinal direction of the engine block. (3) The engine block 12 is provided at its top surface with the elongate rib 42, which also increase the flexural rigidity in the longitudinal direction of the engine block 12.

Additionally, since the flange portion 32 to which the transmission case is secured is formed integrally with the engine block 12 and the bearing support frame 28, the flexural rigidity of the connection between the engine block 12 and a transmission (no shown) is considerably increased to increase the flexural rigidity of a power drive line (not shown) which carries the power of the engine to the drive wheels of a motor vehicle though not shown. This contributes to the decrease in the vibration of the power drive line which is one of the major sources of the noises in a passenger compartment (not shown) of the vehicle.

It will be appreciated from the foregoing, that according to the present invention, engine vibration decreasing can be achieved even though the piston stroke is shortened.

Furthermore, since the engine block 12 is not provided at its bottom portion with the skirt portion and the oil pan which are major sources of engine noises, the engine noises dependent on them can be removed. Additionally, the sound-insulating cover 46 is elastically secured through the insulating member 56 to the engine block 12, the cover itself does not become a noise radiating source, preventing noises of the engine block 12 from being radiated to ambient air.

Moreover, the top portion of the engine block 12 including the valve operating mechanism 44 is covered double with the rocker cover 52 and the top insulating cover 54 and therefore the noises from the valve operating mechanism 44 are effectively minimized. In this connection, the noises from the valve operating mechanism 44 seems to cause the rocker cover 52 to vibrate and passes through the rocker cover 52. It will be understood from the foregoing that, according to the present invention, generation of engine noises is effectively suppressed in addition to the suppression effect for engine vibration.

It will be appreciated that the integrally formed engine block 12 does not include a cylinder head and a cylinder block which are separately and independently formed, and therefore precise machining for the contacting surfaces of the cylinder head and cylinder block never be required. This contributes to the decrease in the number of constituting parts of the engine, simplifying the process of engine assembly.

Otherwise, the engine height is considerably decreased by shortening the piston stroke and therefore the center of gravity of the motor vehicle resides at a considerably lower position of the vehicle. This contributes greatly to the stabilization of a cruising vehicle and to increase in possibility of vehicle design.

What is claimed is:

1. A reciprocating piston internal combustion engine, comprising:

an integrally formed engine block including a cylinder block portion which is formed therein with cylinders, and a cylinder head portion, said cylinder block portion carrying a generally semicylindrical part of each of main bearings for supporting the rotatable journal of a crankshaft; pistons reciprocally disposed in said cylinders, respectively, a combustion chamber being defined between the crown of each piston and said cylinder head, the piston stroke of each piston being the same as or smaller than the bore diameter of each cylinder a bearing support frame secured to said cylinder block portion of said engine block, and carrying the other generally semicylindrical part of each of the main bearings, the semicylindrical part carried by said bearing support constituting a generally cylindrical main bearing in cooperation with the semicylindrical part carried by said cylinder block portion; and a sound-insulating cover elastically secured to said engine block in spaced relation to and around the engine block to cover the outer surface of the cylinder block portion of said engine block.

2. A reciprocating piston internal combustion engine as claimed in claim 1, in which said integrally formed engine block is made by casting said cylinder block portion integrally with said cylinder block portion.

3. A reciprocating piston internal combustion engine as claimed in claim 2, in which the main bearing semicylindrical part carried by said cylinder block portion is located symmetrically to the main bearing semicylindrical part carried by said bearing support flame, with respect to a partition plane at which said cylinder block portion is secured to said bearing support frame.

4. A reciprocating piston internal combustion engine as claimed in claim 3, in which said bearing support frame is secured to said cylinder block portion of said engine block by a plurality of bolts which are disposed parallelly with axes of the cylinders.

5. A reciprocating piston internal combustion engine as claimed in claim 2, further comprising an elastomeric member through which said sound-insulating cover is secured to the outer surface of the cylinder block portion of said engine block, said elastomeric member being disposed between the inner surface of said sound-insulating cover and the outer surface of the cylinder block portion of said engine block to provide gas-tight and liquid-tight seals between the cylinder block portion and said sound-insulating cover.

6. A reciprocating internal combustion engine as claimed in claim 5, in which said sound-insulating cover is formed at its bottom-most portion with an oil pan for reserving an engine oil.

7. A reciprocating piston internal combustion engine as claimed in claim 2, further comprising an elongate rib formed on the top surface of the cylinder head portion of said engine block, said elongate rib being located along the longitudinal direction of the engine block.

8. A reciprocating piston internal combustion engine as claimed in claim 2, further comprising a top insulating cover elastically secured to the cylinder head portion of said engine block to cover a rocker cover for covering a valve operating mechanism operatively mounted on said cylinder head portion.

9. A reciprocating piston internal combustion engine as claimed in claim 8, further comprising an elastomeric member through which said top insulating cover is secured to the lower portion of said rocker cover, said elastomeric member being disposed between the outer surface of the lower portion of said rocker cover and the inner surface of said top insulating cover.

10. A reciprocating piston internal combustion engine as claimed in claim 8, further comprising a circular member to which a transmission case is secured, including first and second generally semicircular plate members which are secured to each other with bolts, said first and second generally semicircular plate members being formed integrally with said engine block and said bearing support frame, respectively.

11. A reciprocating piston internal combustion engine as claimed in claim 2, in which the distance between the adjacent main bearings is larger than the bore diameter of the cylinder.

* * * * *